US008885857B2

(12) United States Patent
Rank et al.

(10) Patent No.: US 8,885,857 B2
(45) **Date of Patent: *Nov. 11, 2014**

(54) SYSTEM FOR ESTABLISHING A CONVERSATION GROUP AMONG A NUMBER OF HEARING AIDS

(75) Inventors: Mike Lind Rank, Farum (DK); Jakob Nielsen, Copenhagen (DK); Michael Ungstrup, Allerod (DK); Kristian Thygesen Gjesse, Valby (DK)

(73) Assignee: Widex A/S, Lynge (DK)

( * ) Notice: Subject to any disclaimer, the term of this patent is extended or adjusted under 35 U.S.C. 154(b) by 667 days.

This patent is subject to a terminal disclaimer.

(21) Appl. No.: 12/636,092

(22) Filed: Dec. 11, 2009

(65) Prior Publication Data

US 2010/0086156 A1 Apr. 8, 2010

Related U.S. Application Data

(63) Continuation-in-part of application No. PCT/DK2007/050070, filed on Jun. 13, 2007.

(51) Int. Cl.
*H04R 25/00* (2006.01)

(52) U.S. Cl.
CPC ..... *H04R 25/554* (2013.01); *H04R 2225/55* (2013.01)
USPC ..... 381/315; 381/312

(58) Field of Classification Search
USPC ..... 381/312–331
See application file for complete search history.

(56) References Cited

U.S. PATENT DOCUMENTS

| | | | | |
|---|---|---|---|---|
| 4,548,082 | A | 10/1985 | Engebretson et al. | |
| 5,721,783 | A | 2/1998 | Anderson | |
| 6,696,973 | B1 | 2/2004 | Ritter et al. | |
| 6,879,695 | B2 * | 4/2005 | Maltan et al. | 381/315 |
| 2002/0128030 | A1 | 9/2002 | Eiden et al. | |
| 2003/0133582 | A1 | 7/2003 | Niederdrank | |
| 2005/0157896 | A1 | 7/2005 | Maltan et al. | |
| 2006/0039577 | A1 | 2/2006 | Sanguino et al. | |
| 2006/0067550 | A1 | 3/2006 | Puder et al. | |
| 2008/0123865 | A1 | 5/2008 | Beck | |
| 2008/0200159 | A1 * | 8/2008 | Lai | 455/416 |

FOREIGN PATENT DOCUMENTS

| | | |
|---|---|---|
| EP | 1460769 A1 | 9/2004 |
| EP | 1643801 A2 | 4/2006 |
| EP | 1657958 A1 | 5/2006 |

(Continued)

OTHER PUBLICATIONS

International Search Report Apr. 9, 2008 for PCT/DK2008/050140.

(Continued)

*Primary Examiner* — Matthew Eason
(74) *Attorney, Agent, or Firm* — Sughrue Mion, PLLC

(57) ABSTRACT

A system for establishing within a communication network a conversation group between a number of hearing aids (1, 2; 3, 4, 5) used by different users, comprises a number of hearing aids (1, 2, 3, 4, 5) adapted for wireless communication, means for detecting hearing aids (1, 2, 3, 4, 5) available for participation in the communication network, means for selecting hearing aids for participation (1, 2, 3, 4, 5) in said network, and a shared wireless communication unit (10) adapted for transmitting to and from the hearing aids (1, 2; 3, 4, 5) participating in said communication network. The invention further provides a method for establishing a conversation group.

24 Claims, 3 Drawing Sheets

(56) References Cited

FOREIGN PATENT DOCUMENTS

| | | | |
|---|---|---|---|
| EP | 1915031 | A2 | 4/2008 |
| JP | 2002261702 | A | 9/2002 |
| JP | 2006-13719 | A | 1/2006 |
| JP | 2006050028 | A | 2/2006 |
| JP | 2006-72812 | A | 3/2006 |
| WO | 0028783 | A1 | 5/2000 |
| WO | 0028784 | A1 | 5/2000 |
| WO | 2006074655 | A1 | 7/2006 |
| WO | 2006133158 | A1 | 12/2006 |

OTHER PUBLICATIONS

International Preliminary Report on Patentability Sep. 9, 2009 for PCT/DK2008/050140.

International Search Report Jun. 18, 2008 for PCT/DK2007/050070.

Opinion International Searching Authority for PCT/DK2007/050070.

Office Action for JP2009-538590 dated Oct. 25, 2011, with English translaiton.

OA for Japanese Application JP2010-509683 dated Apr. 3, 2012.

* cited by examiner

SYSTEM FOR ESTABLISHING A CONVERSATION GROUP AMONG A NUMBER OF HEARING AIDS

RELATED APPLICATIONS

The present application is a continuation-in-part of application No. PCT/DK2007050070, filed on Jun. 13, 2007, in Denmark and published as WO 2008151623 A1.

BACKGROUND OF THE INVENTION

1. Field of the Invention

The present invention relates to hearing aids. The invention, more specifically, relates to a system for establishing a conversation group among a number of hearing aids. The invention further relates to a method of establishing a conversation group among a number of hearing aids.

2. The Prior Art

In many situations small groups of people have to communicate in noisy environments. This may be at a party or a conference where people gather for conversation in pairs or small groups in a larger room. It may also be in a dining room or cafeteria where people gather around different tables. It could also be a recreational living room in an old people's home, where some people may be watching television, some may be small talking, while others sit around a table playing cards or the like.

In such situations the external noise may be a problem, and each of such pairs or small groups of people may have a distinct interest in enhancing sounds from their own internal conversation, while preferably suppressing any disturbing external noise.

SUMMARY OF THE INVENTION

On this background it is a feature of the present invention to suggest a system and a method for providing this while overcoming the problems of the prior art.

According to a first aspect of the invention this feature is achieved by a system for establishing a conversation group among a number of hearing aids used by different users, said system comprising: a number of hearing aids adapted for wireless communication, means for detecting hearing aids available for participation in the conversation group, means for selecting hearing aids for participation in said conversation group, a shared wireless communication unit adapted for transmitting to and from the hearing aids selected for inclusion in said conversation group thereby establishing said conversation group.

Hereby any sound picked up by a hearing aid participating in the conversation group may be wirelessly transmitted directly to the other participants, without having to travel the full distance through the air. Thus, sound from any speaking person may be picked up by his own hearing aid, located only about 15 centimeters away from his mouth, and transmitted wirelessly to the other hearing aids participating in the conversation group, rather than having to travel up to say one to two meters through the air before being picked up by the microphones of the other hearing aids. The attenuation of the sound before it is picked up, and thus the influence of disturbing noise, is thereby greatly reduced, and the intelligibility of the speech increased.

According to a preferred embodiment of the first aspect of the invention a first hearing aid participating in the conversation group comprises a relay device for communicating on one hand with said first hearing aid and communicating on the other hand with said shared communication unit. This is advantageous because of the limited power supply from the batteries in the hearing aid. The transmitting power and hence the power consumption of the transmitter in the hearing can thus be kept at a minimum, because only short range transmission to the relay device is necessary. The relay device may generally be larger than the hearing aid and thus hold more battery capacity, which in turn allows for more powerful transmission to the shared communication unit.

According to another preferred embodiment said relay device comprises means for displaying hearing aids available for participation in said conversation group, and means for manually selecting at least one of said hearing aids for participation in said conversation group. This allows the user to easily identify and select participants for inclusion into a conversation group, and, perhaps even more important, exclusion of undesired participants.

According to an alternative embodiment said system comprising means for detecting the range to a second hearing aid, and automatically selecting said second hearing aid for inclusion into said conversation group based on the range detection. This may present an advantage for the user, who in that case needs not learn how to navigate the conversation group facility of his hearing aid.

According to a further preferred embodiment according to the first aspect of the invention, said relay device is integrated in a remote control for operating said first hearing aid. This is advantageous, because the user of the hearing aid will normally carry the remote control with him. If necessary, the relay device is thus readily available. Moreover the remote control generally has a size allowing for sufficient battery capacity for the transmissions to the shared communication unit, as compared to the hearing aid itself.

According to yet a further preferred embodiment said shared wireless communication unit is a router of a wireless Local Area Network (WLAN). Wireless Local Area Networks have gained wide popularity, inter alia because they are easy to establish and relatively inexpensive. Thus, for may of the locations where it may frequently be advantageous for occupants to establish a conversation group between a number of hearing aids users, the necessary infrastructure may easily be established. Thus a specific dedicated base station will not be necessary.

According to yet another preferred embodiment of the first aspect of the present invention, all hearing aids connected to said shared wireless communication unit is a router of a wireless Local Area Network, and wherein all hearing aids connected to said Local Area Network are displayed for selection on said relay device. This allows the user to freely select other participants, and even get in touch with someone quite far away, such as in an other room in the building.

According to a further preferred embodiment of the invention said system comprises a control unit adapted for registering and keeping a record of hearing aids connected to said wireless Local Area Network. This is advantageous as such a control unit may be implemented using application software on a standard computer connected to the router, thus not necessitating any modification of a standard router. Moreover this control unit could be used for the task of allocating an intelligible identification to each hearing aid system, rather than implementing this in the hearing aids or relay devices.

Furthermore, said control unit is preferably adapted for keeping track of conversation groups established on said Local Area Network and their participants. This allows existing conversation groups to be displayed as groups on the relay unit of a hearing aid system, so as to make identification easier. Vice versa, the display of existing conversation groups or their participants could be suppressed from display. A further hearing aid would thus not be able to see the conversation group, and would only be able to join if allowed, e.g. upon selection by someone already participating in the conversation group.

According to a further preferred embodiment of the first aspect of the invention, said relay device comprises at least one built in microphone, preferably a directional microphone. This allows a hearing aid user to place his own relay device in front of himself and pointing towards him, so as to have a directional microphone directed to pick up his speech rather than the built-in microphones of his hearing aid. More important however, it would also allow a person not using a hearing aid to participate in the conversation group. For instance he may simply borrow a relay device from one of the other participants and place it in front of himself so as to allow the other hearing aid users to hear his speech via the relay device.

The feature of the invention is also achieved by a second aspect of the invention according to which there is provided a method for establishing within a communication network a conversation group that includes a number of hearing aids used by different users, said method comprising, providing a number of hearing aids adapted for wireless communication, providing a means for detecting hearing aids available in the communication network, providing a means for selecting hearing aids for participation in said conversation group, providing a shared wireless communication unit, and transmitting communication signals to and from the hearing aids participating in said conversation group via said wireless communication unit.

BRIEF DESCRIPTION OF THE DRAWINGS

The invention will now be described in greater detail based on non-limiting exemplary embodiments and with reference to the schematic drawings. In the drawings, FIG. 1 schematically illustrates a situation where a number of hearing aids according to the invention have formed two conversation groups using a wireless Local Area Network.

DETAILED DESCRIPTION OF THE INVENTION

Figure 1:
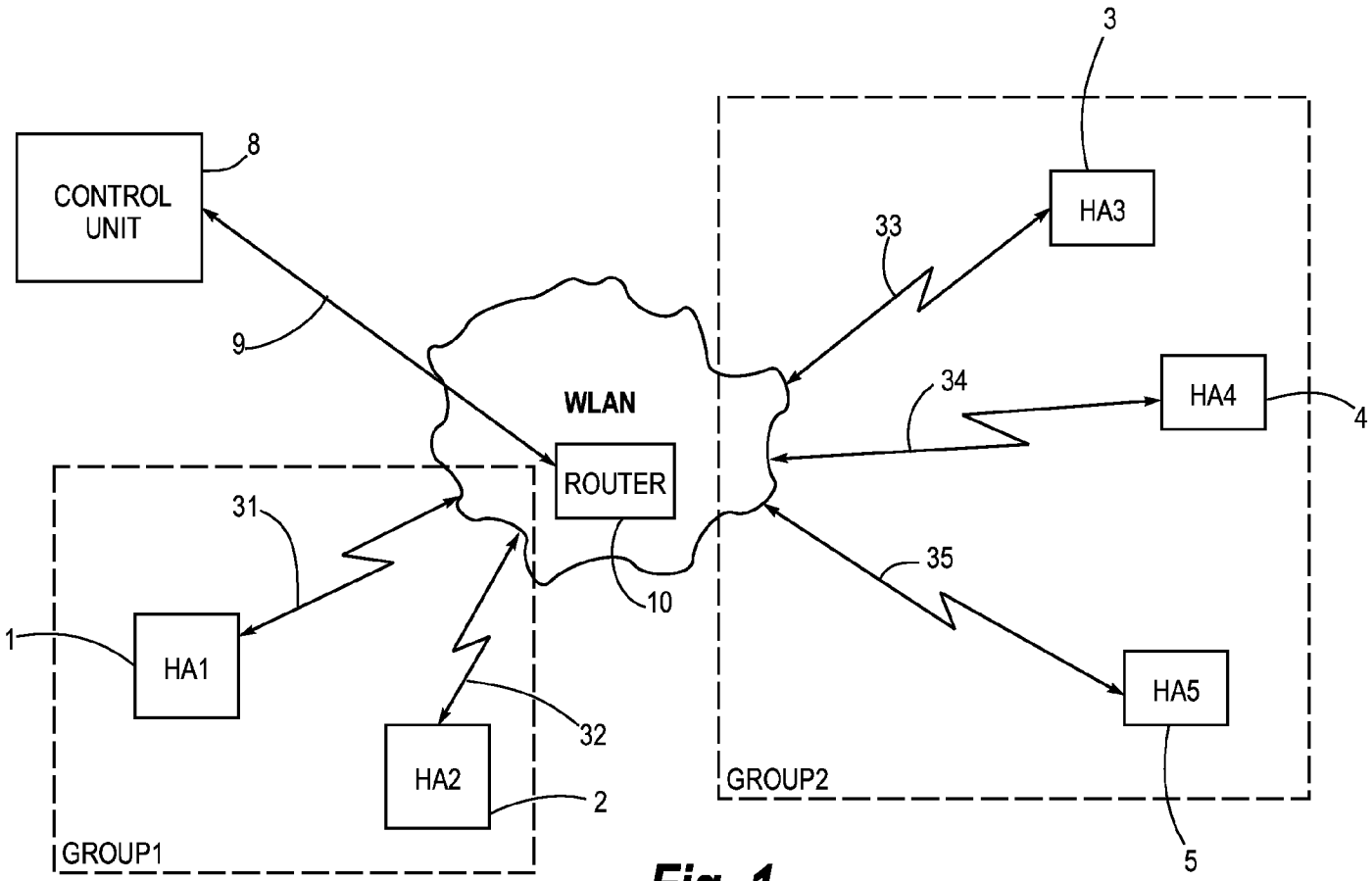
Figure 2:
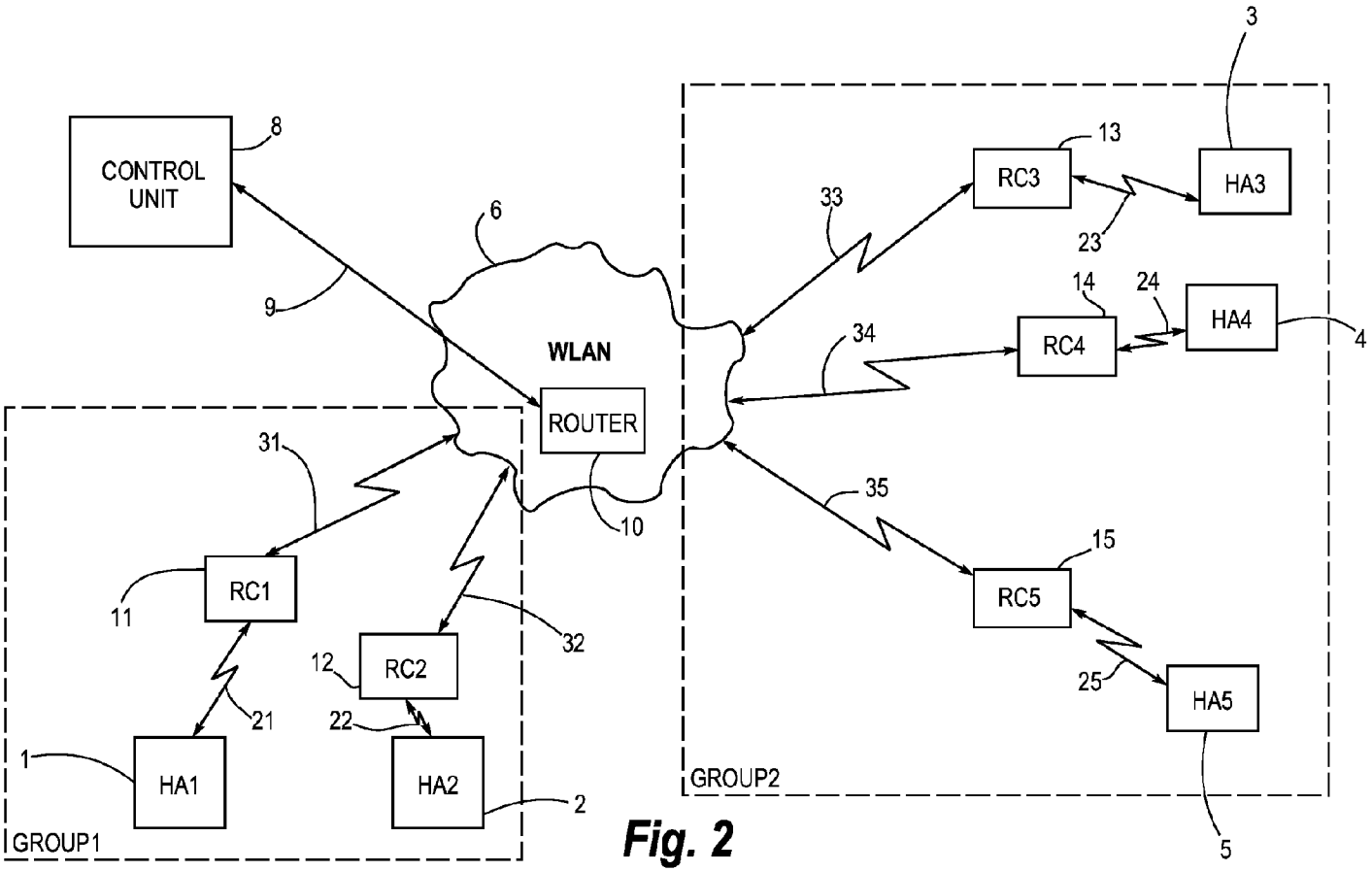
FIG. 2 schematically illustrates a situation where a number of hearing aid systems comprising hearing aids and relay devices according to the invention have formed two conversation groups using direct communication.

In both FIGS. 1 and 2, a number of hearing aids HA1, HA2, HA3, HA4 and HA5, referenced 1, 2, 3, 4, 5, respectively, are illustrated. The hearing aids 1, 2, 3, 4, 5, shown only schematically, may be single hearing aids or binaural systems.

Turning first to FIG. 1 it is illustrated that the hearing aids 1, 2, 3, 4, 5 communicate wirelessly with a shared communication unit, such as a router 10 of a Local Area Network 6, using respective communication links 31, 32, 33, 34, 35. The wireless connection to the Local Area Network is preferably based on one of the IEEE 802.11a/b/g standards, but other wireless access to the Local Area Network, e.g. Bluetooth, may be envisaged.

Wireless Local Area Networks or WLANs based on the IEEE 802.11a/b/g standards have found wide use in private homes and public spaces, and routers for providing such wireless Local Area Networks are readily available commercially at low prices.

Moreover, in FIG. 1 it is indicated with interrupted lines that two conversation groups have been established. One conversation group comprises the hearing aids 1 and 2, communicating with each other via the wireless Local Area Network 6. The other, totally independent conversation group comprises the hearing aids 3, 4, 5, which communicate with each other via the same wireless Local Area Network 6.

A similar system is shown in FIG. 2. In FIG. 2 there is associated a respective relay device RC1, RC2, RC3, RC4 and RC5, referenced 11, 12, 13, 14, 15, respectively, to each of the hearing aids 1, 2, 3, 4, 5, thereby forming a corresponding number of hearing aid systems according to the invention. The hearing aids 1, 2, 3, 4, 5, shown only schematically, may be single hearing aids or binaural systems, in which two hearing aids share one single relay device, 11, 12, 13, 14, 15 respectively. In the figures the number of illustrated hearing aid systems is five, which suffices for illustration purposes, but in practice there may be any number. The communication between each of the hearing aids 1, 2, 3, 4, 5 and its respective relay device 11, 12, 13, 14, 15 takes place via an individualized wireless transmission 21, 22, 23, 24, 25. The wireless transmissions 21, 22, 23, 24, 25 are bi-directional and operate at low power, giving them only a short range. Typically the range is less than one to two meters, so as not to disturb other wireless transmissions 21, 22, 23, 24, 25 between hearing aid systems in the vicinity transmitting on the same frequency, e.g. a corresponding hearing system of another person to whom a user is talking face-to-face. Simple spatial separation, i.e. relying on each transmission being of so low power that it is unlikely to disturb other transmission, which is spaced there from because there is a natural limit to how close people normally let other people physically get to them, is preferred. However, the skilled person will realize that other means of avoiding wireless transmissions disturbing each other exist. Examples of such are temporal separation, where transmission takes place in assigned time-slots, or frequency separation, where transmissions take place on different assigned frequencies, or a combination of both. An example of such a low power relay system is found in WO-A-2006/074655. In this system the relay device is a remote control communicating bi-directionally with a computer, allowing audio to be streamed to the hearing aid from the computer.

FIG. 2 further illustrates that the relay devices 11, 12, 13, 14, 15 communicate wirelessly with a router 10 of Local Area Network 6 using respective communication links 31, 32, 33, 34, 35. The wireless connection to the Local Area Network is preferably based on one of the IEEE 802.11a/b/g standards, but other wireless access to the Local Area Network may be envisaged.

Moreover, in FIG. 2 it is indicated with interrupted lines that two conversation groups have been established. One conversation group comprises the relay devices 11 and 12 of the respective hearing aids 1 and 2, the relay devices 11, 12 communicating with each other via the wireless Local Area Network 6. The other, totally independent conversation group comprises the relay devices 13, 14, 15 of the hearing aids 3, 4, 5, where the relay devices 13, 14, 15 communicate with each other via the same wireless Local Area Network 6.

The embodiment according to FIG. 2 is currently preferred as best mode over that of FIG. 1, and the remainder of the description will be given based on FIG. 2, unless stated otherwise. For the sake of simplicity, reference will furthermore only be made to the hearing aid system based on the hearing aid 1. The skilled person will understand that, as far as not stated otherwise, the description will apply likewise to the other hearing aid systems comprising the hearing aids 2, 3, 4 or 5.

When the hearing aid system according to the invention is within range of a wireless Local Area Network, such as WLAN 6 in FIG. 1, this will be detected by the hearing aid system, more specifically by the relay device 11. The presence of the Local Area Network is indicated to the user on the display of his relay device 11, allowing him to connect to it. If several Local Area Networks are present at the same time he may select an appropriate one of them. If the user frequently moves around between several specific wireless Local Area Networks, say at home and at work, an automatic and prioritised connection may be provided. I.e. when he is within reach of his own home Local Area Network he may automatically be connected, without having to chose between his own and e.g. the Local Area Network of the neighbour.

Once connected to a Local Area Network, information indicating the presence of other users on that specific Local Area Network may be detected via the router 10 of the Local Area Network and be presented to him on the display 7 of the relay device 11. This allows the user to have an overview over the other hearing aid systems available for wireless communication over the wireless Local Area Network. Preferably, the relay device 11 allows for setting an intelligible identification of the hearing aid system, such as the user's name, allowing other users to readily identify the user. Alternatively, a control unit 8, such as a computer could store intelligible names corresponding to unique identifiers of hearing aid systems, and keep track of potential participants currently available for or logged onto the wireless Local Area Network. This option is also illustrated in FIG. 1. The connection between the control unit 8 and the wireless router 10 of the Local Area Network 6, needs not be wireless, but could be via a cable connection 9.

Figure 3:
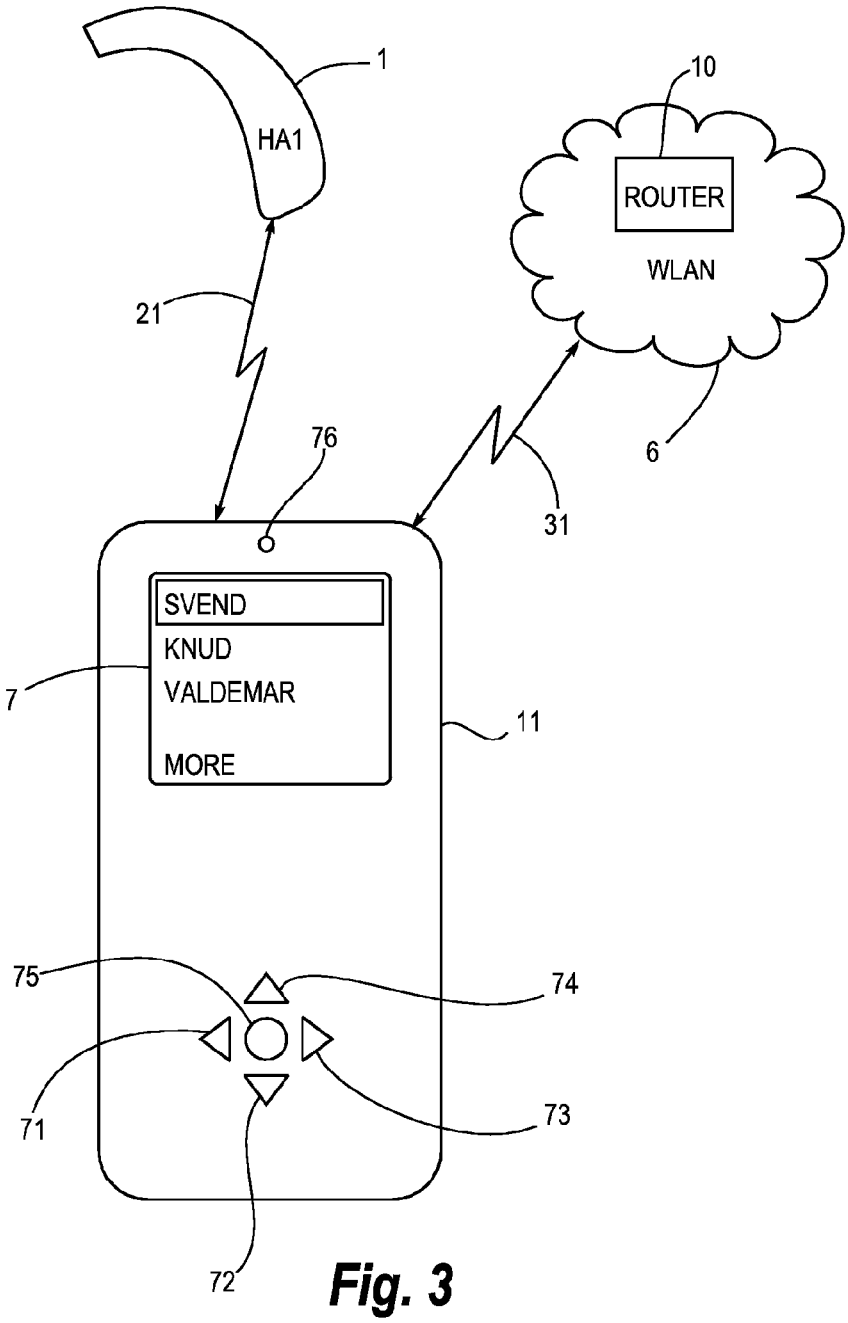
FIG. 3 schematically illustrates a hearing aid system as used in FIG. 2.

As illustrated in FIG. 3, the relay device 11 has identified inter alia three other hearing aid systems belonging to the persons Svend, Knud and Valdemar. These are selectable as participants for a conversation group. The selection may be done using push-buttons 71, 72, 73, 74, 75 in conjunction with menu system on the display 7, allowing the user to navigate the menu. How this is done in detail is well within reach of the skilled person, and does not form part of the present invention. Thus, the skilled person would realise that an alphanumeric keypad, or a finger-touch screen could be used, for typing in things or navigating a menu. Moreover, the skilled person would also realise that even though the focus of this invention is on the establishment of a conversation group, the display of other items on the display 7 is not excluded, in particular the display of other relevant devices on the wireless Local Area Network, such as auxiliary microphone units, or audio streaming devices.

If the hearing aid 1 is itself adapted for the wireless communication with the central communication unit, e.g. for direct connection to a wireless Local Area Network as in FIG. 1, rather than via a relay device as in FIG. 2, acoustic signaling to the user about the presence of other hearing aids on the wireless Local Area Network could be used. A remote control with a display could also be used, even if the remote control itself is not adapted for communication with the wireless Local Area Network.

The establishment of the conversation group may simply be effected by two or more parties selecting each other's hearing aid systems upon mutual agreement. Alternatively, the selection of a desired participant may prompt a request on the display of that desired participant's relay device, which must then be confirmed before the desired participant joins the conversation group.

Rather than indicating all other users on that specific Local Area Network 6 on the display 7 of the relay device 11, it may in many situations be advantageous to show only those other hearing aid systems present in the close vicinity of the hearing aid system in question. This could e.g. be the situation in an old people's home where many hearing aid users are likely to share the same wireless Local Area Network 6, irrespective of whether they are alone in their individual rooms or together with others in a recreational living room. Here other users not present in the recreational room or engaged in conversation at the other end of the room are unlikely to be interesting as partners for conversation, and hence for participation in a conversation group.

In this situation, the relay device 11 may include a proximity detector for the detection of other hearing aid systems, and identification thereof as likely participants to the conversation group. This information may be transmitted to a control unit 8 via the wireless connection 31, so as to allow the control unit 8 to keep track of possible conversation group participants. The control unit 8 is preferably a standard computer connected to the router 10 and running application software for registering and keeping track of hearing aid systems 1, 2, 3, 4, 5 connected to the wireless Local Area Network 6. The connection between the router 10 and the control unit 8 needs not be wireless but could be a cable connection 9. The control unit 8 may also be adapted for keeping track of several established conversation groups and their participants on the wireless Local Area Network 6.

One preferred way of achieving this is to include in the relay device 11 means for detecting the signal strength and an individual code transmitted between another hearing aid 2 and the associated relay device 12. This detection in conjunction with the presence on the wireless Local Area Network 6 would then reduce the number of available participants presented to the user on the display 7 of his relay device 11. Alternatively, the relay device 11 could be fitted with a transponder, or use a separate detection frequency.

Using proximity detection offers the possibility of automatic establishment of a conversation group, with those other hearing aid systems present in the proximity of the hearing aid system. Thus if two or more hearing aid systems are in close proximity the conversation group could be automatically established without the intervention of the respective users. Though this may present advantages for the user, who in that case needs not learn how to navigate the conversation group facility of his hearing aid 1, it does present some drawbacks and is thus less preferred. One such drawback is the loss of privacy, when any passing hearing aid user gets an improved possibility of listening in on a conversation otherwise private. Also, if many hearing aid systems are close to each other, say people in a queue or at a cocktail party, the conversation group could expand in an undesired manner. That is to say, any participant in the conversation group might include further hearing aid systems in the conversation group, which in turn may include further participants, thus expanding the conversation group to a size where it becomes useless for improving communication, because there are too many participants.

The relay device 11 preferably also includes one or more microphones 76, e.g. directional microphones. Thus instead of relying solely on the built-in microphones of the hearing aid the communication could be improved. Thus, if a hearing aid user positions his relay device 11 in front of and pointing towards a speaking person, this may enable him and other participants of the conversation group to better hear this speaking person, who may not be a hearing aid user himself. For the benefit of other hearing aid users he may also position the relay device 11 with the microphone 76 in front of and pointing towards himself. Using a directional microphone of the relay device 11 rather than the built-in microphone of his own hearing aid may give a better sound reception of his voice, i.e. a reception with less disturbing noise because of the directionality. These options are of course contingent on the provision that the relay device 11 is not moved too far away from the associated hearing aid 1. This would also be important in the case, as mentioned earlier, where a person not using a hearing aid borrows a relay device 11, as the lender would otherwise not be able to receive communication from other participants.

If the hearing aid 1 is of the type comprising an additional microphone for picking up sounds in the ear canal, i.e. in the cavity between the earplug of the hearing aid 1 and the tympanic membrane, this additional microphone may be used in extremely noisy surroundings. In that case the speech of the hearing aid user is picked up in the ear canal, and transmitted to the other participants in the conversation group via the relay device 11.

Though the outset of the present invention has been to establish a conversation group between hearing aid users, in order to improve their intercommunication, the inclusion of other devices in the conversation group is not excluded. Thus, a microphone unit enabled for communication with a wireless Local Area Network could participate in the conversation group. This would e.g. allow the lecturer at a conference to address the hearing aid users using the conference room's wireless Local Area Network 6, instead of traditional FM systems. Also, in a private home with a hearing impaired child, the parents could use such a microphone unit enabled for communication with a wireless Local Area Network to communicate with their child via the wireless Local Area Network in the home. Such a microphone unit preferably also includes means for displaying and/or selecting hearing aid systems for participation in a conversation group. Likewise it would show up as a selectable participant on the displays 7 of relay devices 11 of hearing aid systems according to the invention, as indicated above.

If the wireless Local Area Network 6 is moreover connected to the internet, it would even be possible to use the hearing aid system to establish contact with other remote devices via the internet. Thus, the hearing aid 1 could be used as a head-set for IP telephony, if appropriate protocols are implemented, e.g. in the remote device 11 or on a computer connected to the wireless Local Area Network. The skilled person would know how to implement these protocols.

We claim:

1. A system for establishing a conversation group among a number of hearing aids used by different users, said system comprising:

a number of hearing aids each providing compensation for a hearing impairment of its respective user, and each adapted for wireless bidirectional communication, means for detecting hearing aids available for participation in the conversation group, means for selecting at least one but less than all of the available hearing aids for participation in said conversation group, and a shared wireless communication unit adapted for transmitting to and from the hearing aids selected for inclusion in said conversation group thereby establishing said conversation group, such that users of hearing aids included in said conversation group can converse with one another via said shared wireless communication unit.

2. The system according to claim 1, wherein a first hearing aid participating in the conversation group comprises a relay device for communicating on one hand with said first hearing aid and communicating on the other hand with said shared communication unit.

3. The system according to claim 2, wherein said relay device comprises means for displaying hearing aids available for participation in said conversation group, and means for manually selecting at least one of said hearing aids for participation in said conversation group.

4. The system according to claim 1, comprising means for detecting the range to a second hearing aid, and said means for selecting automatically selects said second hearing aid for inclusion into said conversation group based on the range detection.

5. The system according to claim 2, wherein said relay device is integrated in a remote control for operating said first hearing aid.

6. The system according to claim 1, wherein said shared wireless communication unit is a router of a wireless Local Area Network.

7. A system for establishing a conversation group among a number of hearing aids used by different users, said system comprising:

a number of hearing aids each providing compensation for a hearing impairment of its respective user, and each adapted for wireless bidirectional communication, means for detecting hearing aids available for participation in the conversation group, means for selecting hearing aids for participation in said conversation group, and a shared wireless communication unit adapted for transmitting to and from the hearing aids selected for inclusion in said conversation group thereby establishing said conversation group, such that users of hearing aids included in said conversation group can converse with one another via said shared wireless communication unit, wherein a first hearing aid participating in the conversation group comprises a relay device for communicating on one hand with said first hearing aid and communicating on the other hand with said shared communication unit, and wherein said shared wireless communication unit is a router of a wireless Local Area Network, and wherein all hearing aids connected to said Local Area Network are displayed for selection on said relay device.

8. A system for establishing a conversation group among a number of hearing aids used by different users, said system comprising:

a number of hearing aids each providing compensation for a hearing impairment of its respective user, and each adapted for wireless bidirectional communication, means for detecting hearing aids available for participation in the conversation group, means for selecting hearing aids for participation in said conversation group, and a shared wireless communication unit adapted for transmitting to and from the hearing aids selected for inclusion in said conversation group thereby establishing said conversation group such that users of hearing aids included in said conversation group can converse with one another via said shared wireless communication unit, wherein said shared wireless communication unit is a router of a wireless Local Area Network, and said system comprising a control unit adapted for registering and keeping a record of hearing aids connected to said wireless Local Area Network.

9. The system according to claim 8, wherein said control unit is adapted for keeping track of conversation groups established on said Local Area Network and their participants.

10. The system according to claim 2, wherein said relay device comprises at least one built in microphone.

11. A method for establishing within a communication network a conversation group that includes a number of hearing aids used by different users, said method comprising:

providing a number of hearing aids each providing compensation for a hearing impairment of its respective user, and each adapted for wireless bidirectional communication, providing a means for detecting hearing aids available for participation in the conversation group, providing a means for selecting at least one but less than all of the available hearing aids for participation in said conversation group, providing a shared wireless communication unit, and transmitting communication signals to and from the hearing aids participating in said conversation group via said wireless communication unit such that users of hearing aids participating in said conversation group can converse with one another via said wireless communication unit.

12. The method according to claim 11, wherein a first hearing aid participating in the conversation group uses a relay device for communicating on one hand with said first hearing aid and communicating on the other hand with said shared communication unit.

13. A method for establishing within a communication network a conversation group that includes a number of hearing aids used by different users, said method comprising:

providing a number of hearing aids each providing compensation for a hearing impairment of its respective user, and each adapted for wireless bidirectional communication, providing a means for detecting hearing aids available for participation in the conversation group, providing a means for selecting hearing aids for participation in said conversation group, providing a shared wireless communication unit, and transmitting communication signals to and from the hearing aids participating in said conversation group via said wireless communication unit such that users of hearing aids participating in said conversation group can converse with one another via said shared wireless communication unit, wherein a first hearing aid participating in the conversation group uses a relay device for communicating on one hand with said first hearing aid and communicating on the other hand with said shared communication unit, and wherein said hearing aids available for participation in said communication network are displayed on said relay device, and at least one of said hearing aids is manually selected for inclusion in said conversation group.

14. The method according to claim 11, wherein the range from a first hearing aid to a second hearing aid is detected, and said means for selecting automatically selects said second hearing aid for inclusion into said conversation group based on said range detection.

15. The method according to claim 11, wherein a router of a wireless Local Area Network is used as said shared wireless communication unit.

16. A method for establishing within a communication network a conversation group that includes a number of hearing aids used by different users, said method comprising:

providing a number of hearing aids each providing compensation for a hearing impairment of its respective user, and each adapted for wireless bidirectional communication, providing a means for detecting hearing aids available for participation in the conversation group, providing a means for selecting hearing aids for participation in said conversation group, providing a shared wireless communication unit, and transmitting communication signals to and from the hearing aids participating in said conversation group via said wireless communication unit such that users of hearing aids participating in said conversation group can converse with one another via said shared wireless communication unit, wherein the range to a second hearing aid is detected, and said means for selecting automatically selects said other hearing aid for inclusion into said conversation group based on said range detection, and wherein a control unit is used for registering and keeping a record of hearing aids connected to said wireless Local Area Network.

17. The method according to claim 16, wherein said control unit is used for keeping track of conversation groups established on said Local Area Network and their participants.

18. The method according to claim 12, wherein said relay device comprises at least one built-in microphone.

19. The method according to claim 11, wherein at least one hearing aid uses a microphone adapted for picking up sounds in the ear canal of a user.

20. The system according to claim 1, wherein sound picked up by each hearing aid in said conversation group is wirelessly transmitted from an associated relay device to each other hearing aid in said conversation group.

21. The method according to claim 11, wherein sound picked up by each hearing aid in said conversation group is wirelessly transmitted from an associated relay device to each other hearing aid in said conversation group.

22. The system according to claim 1, wherein said shared wireless communication unit communicates with hearing aids included in said conversation group via a Bluetooth® wireless link.

23. The system according to claim 1, including means for displaying hearing aids available for participation in a conversation group with a first hearing aid.

24. The system according to claim 1, wherein said hearing aids selected for inclusion in said conversation group consist of hearing aids separated by no more than about two meters.

* * * * *